US006208317B1

(12) United States Patent
Taylor et al.

(10) Patent No.: US 6,208,317 B1
(45) Date of Patent: Mar. 27, 2001

(54) HUB MOUNTED BENDING BEAM FOR SHAPE ADJUSTMENT OF SPRINGBACK REFLECTORS

(75) Inventors: Robert M. Taylor, Redondo Beach; James R. Gillett, Northridge; Stephen A. Robinson, North Hills; Hans P. Naepflin, Manhattan Beach, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/504,544

(22) Filed: Feb. 15, 2000

(51) Int. Cl.[7] ..... H01Q 15/20

(52) U.S. Cl. ..... 343/915; 343/840

(58) Field of Search ..... 343/915, 912, 343/840, DIG. 2; H01Q 15/20

(56) References Cited

U.S. PATENT DOCUMENTS

| | | | | |
|---|---|---|---|---|
| 4,750,002 | * | 6/1988 | Kommineni | 343/915 |
| 4,845,510 | * | 7/1989 | Chang et al. | 343/915 |
| 5,063,389 | * | 11/1991 | Reits | 343/915 |
| 5,440,320 | * | 8/1995 | Lach et al. | 343/915 |
| 5,680,145 | * | 10/1997 | Thomson et al. | 343/915 |

* cited by examiner

*Primary Examiner*—Michael C. Wimer
(74) *Attorney, Agent, or Firm*—T. Gudmestad

(57) ABSTRACT

The present invention is directed to a method of and a device for adjusting the concavity of a springback antenna reflector. The method and device of the present invention can be used to adjust the concavity of the springback reflector prior to stowage within a satellite to correct actual or anticipated variations in the desired shape of reflector that are caused by storage of the reflector, fabrication of the reflector, thermal effects on the reflector, and moisture absorption by the material from which the reflector is fabricated. By adjusting the concavity of the reflector to correct the variations in the shape of the reflector, degradation of the performance of the reflector due to distortions in the shape of the reflector may be greatly reduced.

16 Claims, 4 Drawing Sheets

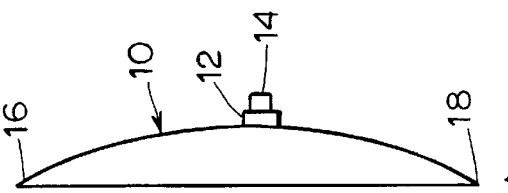
Fig. 3a
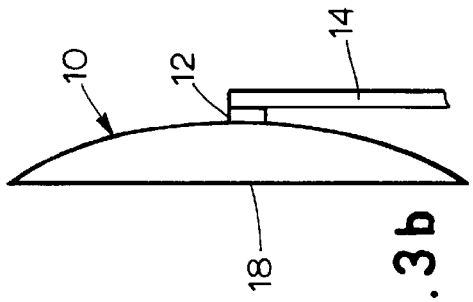
Fig. 3b
Fig. 2a
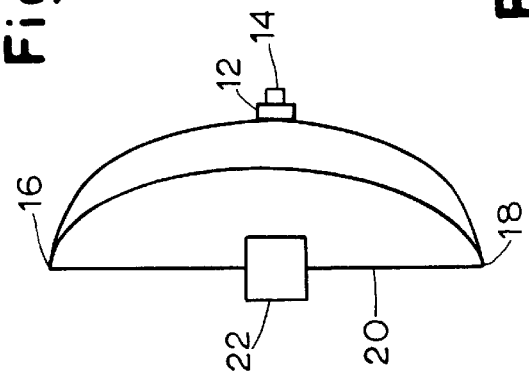
Fig. 2b
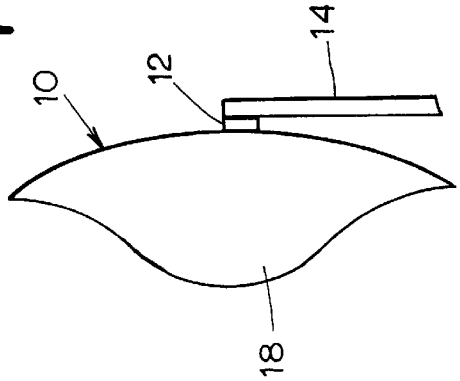
Fig. 1b
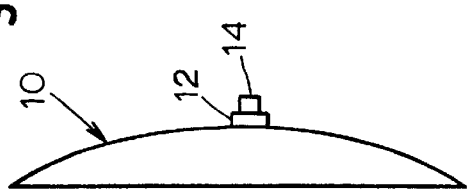
Fig. 1c
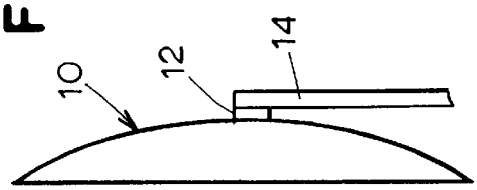

Fig. 4
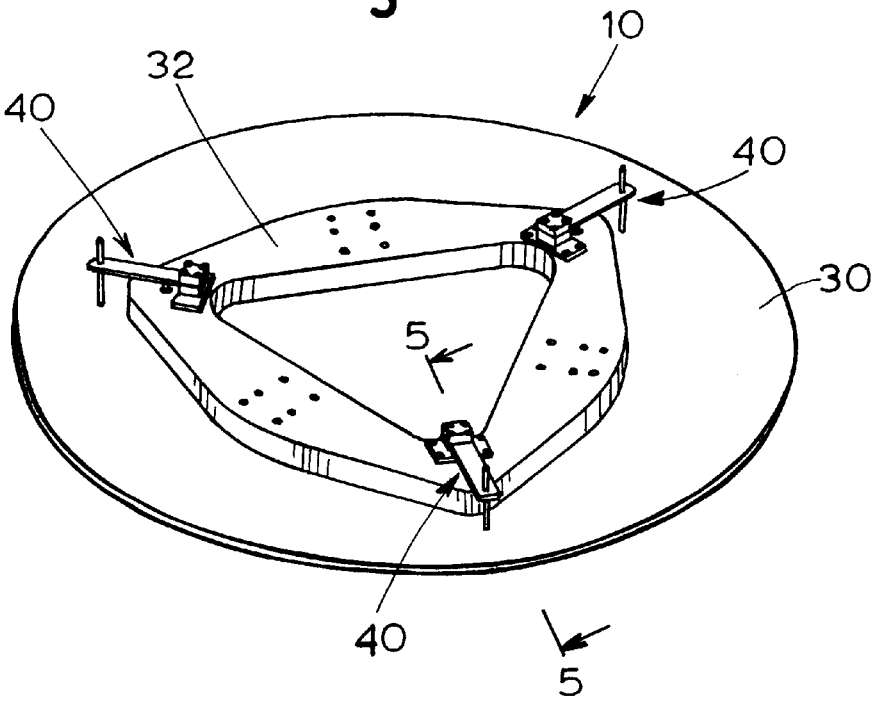
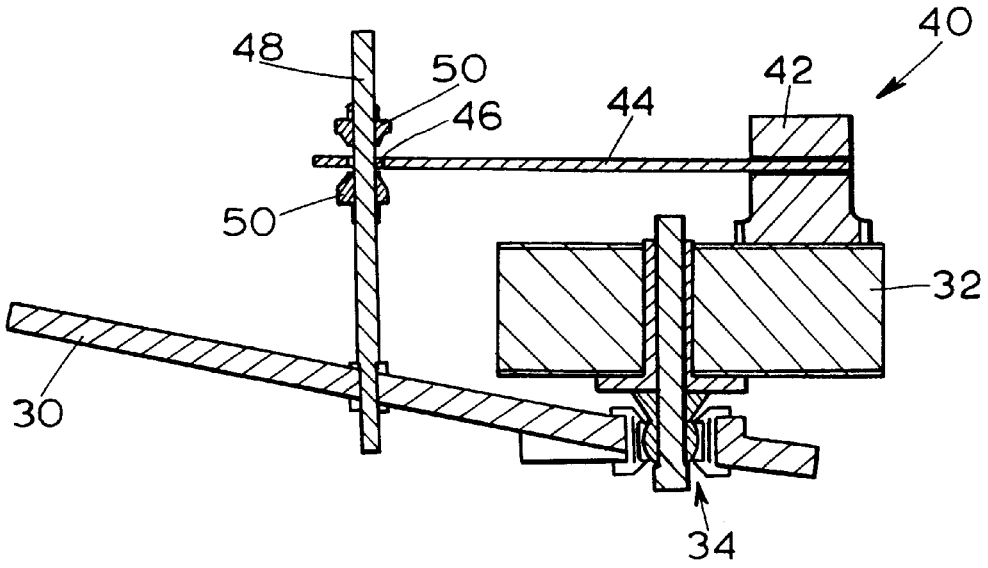
Fig. 5

HUB MOUNTED BENDING BEAM FOR SHAPE ADJUSTMENT OF SPRINGBACK REFLECTORS

This invention was made with U.S. Government support under Contract No. NAS5-32900. The U.S. Government has certain rights in this invention.

BACKGROUND OF THE INVENTION

1. Field of the Invention

The present invention relates generally to spacecraft antenna reflectors and, more particularly, to a hub mounted bending beam for shape adjustment of springback reflectors.

2. Description of the Related Art

Spacecraft antenna reflectors are typically constructed as concave disks. Electrical specifications for the reflector dictate disk dimensions, specifically diameter and cross-sectional curvature. Spacecraft payload weight limits often constrain the reflector thickness to a level that renders the reflector vulnerable to dynamic forces associated with the spacecraft launch. Atmosphere drag and launch booster vibration may be particularly damaging to the reflector if the reflector is mounted in a typical operational configuration (i.e., on support collars on the external surface of the spacecraft) during launch. It is therefore desirable to store the reflectors in a confining envelope designed to protect the reflectors from launch stress.

The shape of the confining envelope requires temporary modification of the intrinsic antenna reflector shape to fit inside the envelope during launch. After launch, the reflectors are released from the envelope and returned to the original shape thereof on deployment. One approach for temporarily modifying the reflector shape is disclosed in Robinson, Simplified Spacecraft Antenna Reflector for Stowage and Confined Envelopes, U.S. Pat. No. 5,574,472, which is expressly incorporated in its entirety by reference herein. In the Robinson patent, a concave reflector fabricated from a flexible, semi-rigid material is deformed by application of a uniform force at diametrically opposed points at the periphery of the reflector. These forces cause the reflector to assume a shape similar to a taco shell which is maintained while the reflector is stowed. Upon deployment, the forces are removed from the reflector and the reflector reassumes its concave shape.

Deforming and stowing the reflector in this manner can cause distortion of the reflector from its desired shape. Additionally, other factors can cause distortion of the reflector from its desired shape. These factors include the predisposition of the reflector to fold on its own after fabrication, and thermal effects on and moisture absorption by the material from which the reflector is fabricated. The distorted shape ultimately results in the degradation of the performance of the reflector after the reflector is deployed and in use by the satellite.

Therefore, there is a need for an improved apparatus and method for adjusting the shape of springback reflectors to correct distortions caused by storage of the reflectors, fabrication of the reflectors, thermal effects and moisture absorption by the reflector material.

SUMMARY OF THE INVENTION

The present invention is directed to a method of and a device for adjusting the concavity of a springback antenna reflector. The method and device of the present invention can be used to adjust the concavity of the springback reflector prior to stowage within a satellite to correct actual or anticipated variations in the desired shape of reflector that are caused by storage of the reflector, fabrication of the reflector, thermal effects on the reflector, and moisture absorption by the material from which the reflector is fabricated. By adjusting the concavity of the reflector to correct the variations in the shape of the reflector, degradation of the performance of the reflector due to distortions in the shape of the reflector may be greatly reduced.

According to one aspect of the present invention, a shape adjustment mechanism is provided for a concave antenna reflector fabricated from a resilient material and having a surface and a coupling member attached to the surface proximate the center of the reflector. The shape adjustment mechanism includes a first support member rigidly mounted on the coupling member, and a resilient member rigidly connected to the first support member. The resilient member has a proximal end that is connected to the first support member, and a free distal end that is offset from the surface of the reflector by a distance. The shape adjustment mechanism further includes a second support member that has a first end rigidly connected to the reflector and a second end proximate the distal end of the resilient member. The shape adjustment mechanism further includes an adjustment member coupled to the second support member and adapted to engage the distal end of the resilient member. When the adjustment member is moved longitudinally along the second support member, the adjustment member engages the distal end of the resilient member such that the distance between the distal end of the resilient member and the surface of the reflector is varied as the adjustment member moves toward or away from the reflector.

In one alternative embodiment of the present invention, the resilient member of the shape adjustment mechanism may be in the form of a leaf spring having an aperture proximate the distal end with the second end of the second support member passing through the aperture. In this embodiment, the shape adjustment member may engage the leaf spring in the area proximate the aperture in order to vary the distance between the distal end of the leaf spring and the surface of the reflector. In another alternative embodiment, the second support member includes external threads and the adjustment member is a pair of threaded nuts disposed on either side of the resilient member. The nuts move longitudinally along the second support member as the nuts are rotated and engage the resilient member in either direction to vary the distance between the distal end and the reflector. In yet another alternative embodiment, the adjustment mechanism is disposed on the concave side of the reflector.

According to another aspect of the present invention, an antenna reflector is provided that includes a concave dish fabricated from a resilient material and a coupling member attached to a surface of the dish proximate the center of the dish. The antenna reflector further includes a first support member rigidly mounted on the coupling member, and a resilient member rigidly connected to the first support member. The resilient member has a proximal end that is connected to the first support member, and a free distal end that is offset from the surface of the dish by a distance. The antenna reflector further includes a second support member that has a first end rigidly connected to the dish and a second end proximate the distal end of the resilient member. The antenna reflector further includes an adjustment member coupled to the second support member and adapted to engage the distal end of the resilient member. When the adjustment member is moved longitudinally along the second support member, the adjustment member engages the distal end of the resilient member such that the distance between the distal end of the resilient member and the surface of the dish is varied as the adjustment member moves toward or away from the dish.

In one alternative embodiment of the present invention, the resilient member of the antenna reflector may be in the form of a leaf spring having an aperture proximate the distal end with the second end of the second support member passing through the aperture. In this embodiment, the shape adjustment member may engage the leaf spring in the area proximate the aperture in order to vary the distance between the distal end of the leaf spring and the surface of the dish. In another alternative embodiment, the second support member includes external threads and the adjustment member includes a pair of threaded nuts disposed on either side of the resilient member. The nuts move longitudinally along the second support member as the nuts are rotated and engage the resilient member in either direction to vary the distance between the distal end and the dish. In yet another alternative embodiment, the adjustment mechanism is disposed on the concave side of the dish.

According to a still further aspect of the present invention, a method for adjusting a concave antenna reflector is provided for use with a reflector fabricated from a resilient material and having a surface and a coupling member attached to the surface proximate the center of the reflector. The method includes the steps of rigidly mounting a first support member on the coupling member and a second support member on the reflector. The method further includes the step of rigidly connecting a resilient member to the first support member. The resilient member has a proximal end rigidly connected to the first support member and a distal end disposed proximate the second support member. Configured in this manner, the distal end of the resilient member is separated from the surface of the reflector by a distance. The method further includes the step of changing the distance between the distal end of the resilient member and the surface of the reflector by moving an adjustment member longitudinally along the second support member. The adjustment member engages the distal end of the resilient member to move the distal end to one of increase and decrease the distance between the distal end and the surface. In alternative embodiments of the present invention, the surface of the reflector may be disposed on either the concave or convex side of the reflector.

The features and advantages of the invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 1(*b*) is a top view of the springback reflector of FIG. 1(*a*);

FIG. 1(*c*) is a side view of the springback reflector of FIG. 1(*a*);

FIG. 2(*a*) is a top view of the springback reflector of FIG. 1(*a*) in a stowed configuration;

FIG. 2(*b*) is a side view of the springback reflector of FIG. 1(*a*) in a stowed configuration;

FIG. 3(*a*) is a top view of the springback reflector of FIG. 1(*a*) in a deployed configuration;

FIG. 3(*b*) is a side view of the springback reflector of FIG. 1(*a*) in a deployed configuration;

FIG. 4 is a perspective view of the hub portion of the springback reflector of FIG. 1(*a*) including the adjustment mechanism according to the present invention;

FIG. 5 is a side elevation sectional view taken along line 5—5 of the hub portion and the adjustment mechanism of FIG. 4;

DETAILED DESCRIPTION OF THE PREFERRED EMBODIMENTS

Figure 1A:
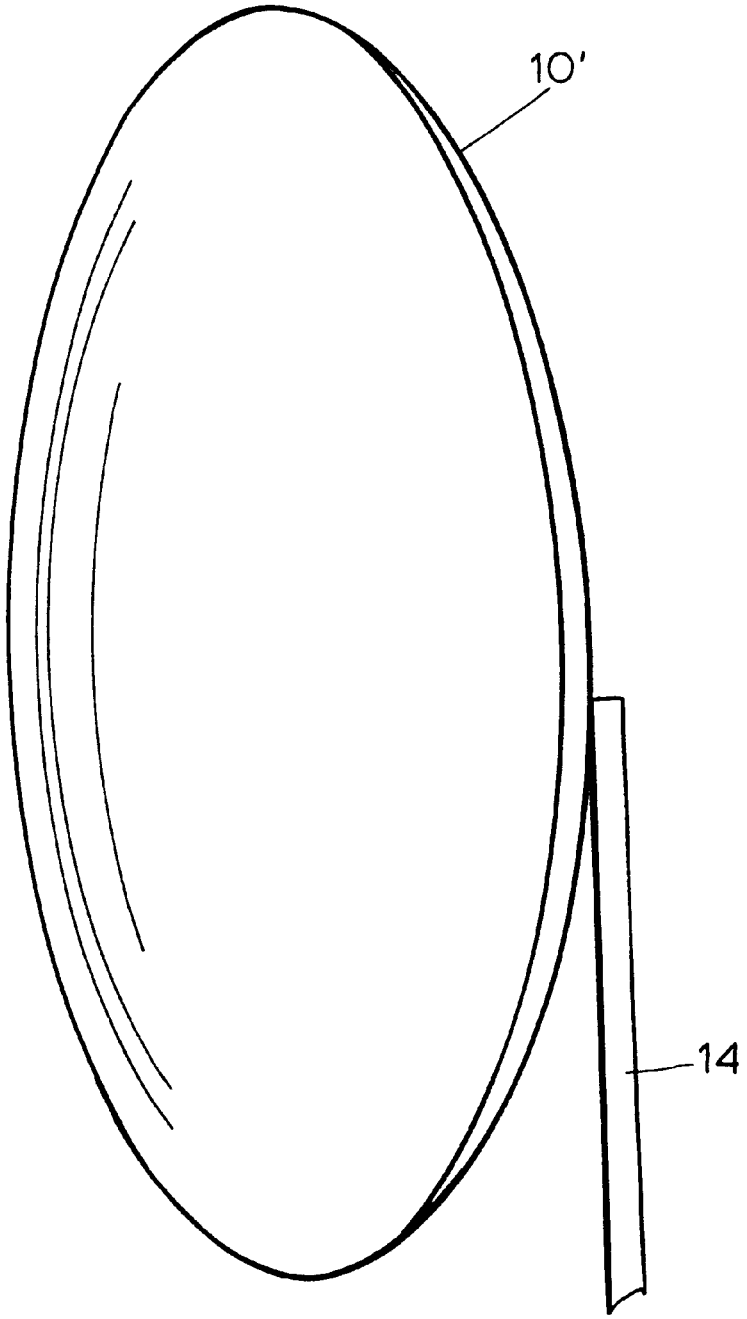
FIG. 1(*a*) is a simplified perspective view of an illustrative embodiment of a springback reflector in a manufactured configuration useful with the shape adjustment mechanism according to the present invention.

A springback antenna reflector is provided with elastic characteristics which allow the shape of the reflector to be redefined for stowage and returned to an original shape on deployment. FIG. 1(*a*) is a simplified perspective diagram of an illustrative embodiment of the flexible thin-shell springback antenna reflector 10 in a manufactured configuration.

FIG. 1(*b*) is a top view of the illustrative embodiment of the antenna reflector 10 in a manufactured configuration. FIG. 1(*c*) is a side view of the illustrative embodiment of the antenna reflector 10 in a manufactured configuration. As shown in FIGS. 1(*a*)–(*c*), in the illustrative embodiment, the reflector 10 is a parabolic shell having a coupling fixture 12 attached to the center thereof to which a support mast 14 is coupled.

The reflector 10 is constructed of a single thin, concave homogeneous sheet of flexible, semi-rigid material such as graphite-fiber reinforced plastic. The reflector 10 may be fabricated in a conventional manner, i.e., multi-layer lamination over a precision form of the correct shape. The dimensions of the reflector 10 may be determined in a conventional manner. The reflector may be made of conductive material or nonconductive material which is coated with conductive material. A design consideration of significant importance is that the reflector 10 be sufficiently flexible to be deformed into a stowage shape and deployed to a fully non-deformed state on deployment. This requires a construction in which the deformation strain on the reflector 10 is below the creep strain limit, that is, the force at which the reflector will not return to the original shape.

FIG. 2(*a*) is a top view of the illustrative embodiment of the antenna reflector 10 in a stowed (deformed) configuration. FIG. 2(*b*) is a side view having a substantially U-shaped cross-section of the illustrative embodiment of the antenna reflector 10 in the stowed configuration. FIG. 3(*a*) is a top view of the illustrative embodiment of the antenna reflector 10 in a deployed configuration and FIG. 3(*b*) is a side view of the illustrative embodiment of the antenna reflector 10 in the deployed position.

As illustrated in FIG. 2(*a*), the reflector 10 is deformed by the application of a uniform force at diametrically opposed points 16 and 18 at the periphery of the reflector 10. The reflector 10 may be maintained in the stowed configuration by a string 20 as shown in FIG. 2(*a*), or by a container (not shown) in which the reflector 10 is stowed, e.g., the side rails of a space shuttle. If a string is used, it may be cut by pyrotechnic device 22. In the alternative, a material may be chosen for the reflector 10 which allows the reflector 10 to be deformed at one temperature and maintained in the deformed state until deployed at another temperature. In short, the invention is not limited to the manner in which the reflector 10 is maintained in a deformed state and deployed.

The springback reflector obviates the disadvantages of a segmented design by providing a single-piece homogeneous reflector that can be fabricated using existing manufacturing processes, which can be deformed to fit into a protective launch envelope and returned to the desired shape upon deployment. No excess weight from cantilevers and motors is necessary, no motor control systems are required to perform stowage deformation or redeployment, and the lack of segmentation virtually eliminates possible catenation effects. The springback reflector allows the elimination of the manufacturing steps required for segmenting conventional reflectors, including costly cantilevers, ribs, and motor and control systems, and therefore allows significant cost savings.

Although the springback reflector is designed to return to the desired concave shape, the deformation and stowage of the reflector in the manner described above can cause distortion of the reflector from its desired shape. Additionally, other factors can cause distortion of the reflector from its desired shape. These factors include the predisposition of the reflector to fold on its own after fabrication, and thermal effects on and moisture absorption by the material from which the reflector is fabricated. The distorted shape ultimately results in the degradation of the performance of the reflector after the reflector is deployed and in use by the satellite.

In order to ensure that the springback reflector assumes the desired concave shape upon deployment, an adjustment mechanism according to the present invention is mounted on the hub portion of the reflector. The hub portion 30 of a reflector 10 implementing the present invention is shown in FIG. 4. The hub portion 30 has a support panel 32 connected thereto at three equally spaced points in a manner that will be discussed in greater detail with reference to FIG. 5. Referring to FIG. 4, the reflector 10 further includes three shape adjustments assemblies 40 connected to both the hub portion 30 and the support panel 32 proximate each of the points at which the support panel 32 is coupled to the hub portion 30.

The support panel 32, along with the coupling fixture 12 and the support mast 14, provides the primary mechanical interface between the reflector 10 and the spacecraft (not shown). A receiving device, such as a feed horn (not shown), is mounted on the support panel 32 and is positioned at the desired focal point of the reflector 10. The receiving device is electromechanically coupled to the coupling fixture 12 and the support mast 14 through an opening in the center of the reflector 10 and, in turn, connected to the spacecraft. Electromagnetic energy reflected by the reflector 10 is detected by the receiving device and passed through the coupling fixture 12 and mast 14 to the spacecraft for processing.

Referring to FIG. 5, the attachment mechanism for the support panel 32 and the shape adjustment mechanism 40 according to the present invention are shown in greater detail. The support panel 32 is mounted on the hub portion 30 at three points by monoball mounts 34 that are evenly spaced about the center of the reflector 10. The monoball mounts 34 provide a moment-free connection which allows a slight rotation of the reflector 10 with respect to the support panel 32 when the reflector 10 is deformed into the stowed configuration and when the adjustment mechanisms 40 are manipulated to adjust the shape of the reflector 10.

The adjustment mechanism 40 includes a first support member 42 that is rigidly mounted to the support panel 32 proximate one of the monoball mounts 34 and which extends upwardly away from the support panel 32 and reflector 10. The adjustment mechanism 40 further includes a resilient member 44 in the form a leaf spring having a free distal end and a proximal end that is rigidly connected to the support member 48, thereby forming a cantilever beam which extends outwardly from the first support member 42 beyond the outer edge of the support panel 32. The resilient member 44 has an aperture 46 proximate the distal end and located beyond the outer edge of the support panel 32.

The adjustment mechanism 40 further includes a second support member 48 having external threads and an outer diameter that is smaller than the inner diameter of the aperture 46. The second support member 48 is rigidly connected at one end to the hub portion 30 and extends upwardly from the hub portion 30 in the same general direction as the first support member 42. The free end of the second support member 48 passes through the aperture 46 of the resilient member 44. Spherical adjusting nuts 50 engage the external threads of the second support member 48 and are located on either side of the aperture 46. The spherical heads of the nuts 50 engage the resilient member 44 as the nuts 50 move longitudinally along the second support member 48 such that a force parallel to the longitudinal axis of the second support member 48 may be applied to the resilient member 44 without creating a moment at the distal end. In an alternative embodiment, the resilient member 44 may include a monoball mount at the aperture 46 that is engaged by nuts 50 with flat faces that are screwed on to the posts 48 on either side of the resilient member 44.

Figure 6:
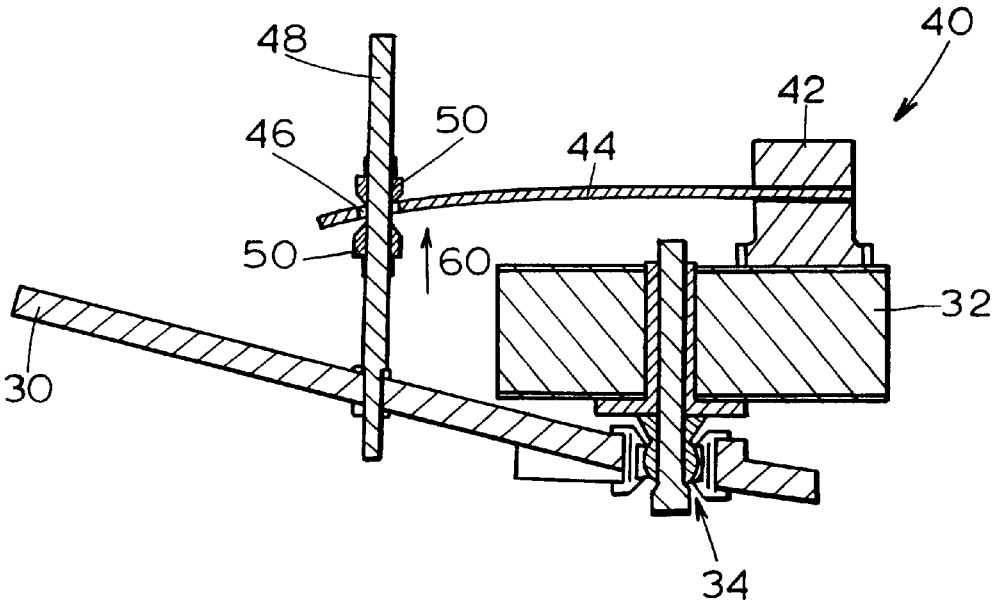
FIG. 6 is a side elevation sectional view taken along line 5—5 of the hub portion and the adjustment mechanism of FIG. 4 in a first adjusted position.

Tuning of the reflector 10 is performed prior to stowing the reflector 10 in the spacecraft for launch. The geometry of the reflector 10 after assembly is measured using a well-known process, such as photogrametry. The information of the reflector geometry is used to determine the adjustments necessary to correct the distortions caused by effects such as stowing the reflector in a deformed position, the reflector's tendency to fold on its own, thermal effects, and the effects of moisture absorption. Once the necessary adjustments are determined, the shape adjustment mechanisms 40 are manipulated by moving the nuts 50 in the longitudinal direction along the second support member 48 to tune the reflector 10 to the desired shape. If the area of the reflector 10 proximate a given shape adjustment mechanism 40 requires increased concavity, the nuts 50 are rotated in the direction that moves the distal end of the resilient member 44 closer to the hub portion 30 of the reflector 10. By forcing the end of the resilient member 44 toward the hub portion 30, the resilient member 44 exerts a force in the upward direction as indicated by arrow 60 in FIG. 6. The monoball mount 34 proximate the adjustment mechanism 40 allows the reflector 10 to rotate about the monoball mount 34 to increase the concavity of the reflector 10. Additionally, the spherical heads of the nuts 50 ensure that the force 60 is exerted along the longitudinal axis of the second support member 48 without creating a moment on the resilient member 44 at the distal end.

Figure 7:
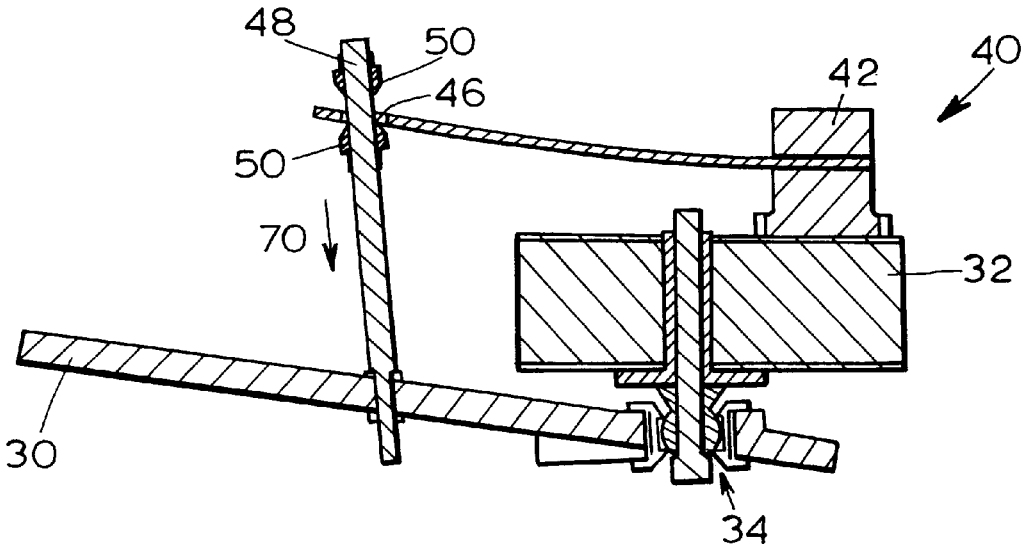
FIG. 7 is a side elevation sectional view taken along line 5—5 of the hub portion and the adjustment mechanism of FIG. 4 in a first adjusted position.

If the concavity of the reflector 10 must be decreased to achieve the desired shape, the nuts 50 are rotated in the opposite direction to engage the distal end of the resilient member 44, thereby forcing the distal end of the resilient member 44 away from the hub portion 30 as shown in FIG. 7. As the end of the resilient member 44 is forced away from the hub portion 30, the resilient member 44 exerts a force in the downward direction, as indicated by the arrow 70, that tends to flatten the shape of the reflector 10. After the calculated adjustments have been made, the geometry of the reflector 10 is measured again to determine if additional adjustments are necessary to tune the reflector 10 to the desired shape.

Although the adjustment mechanisms 40 as illustrated herein utilize the threaded nuts 50 on the second support member 48 to apply a force to the resilient member 44, which is in the form of a leaf spring, other configurations for adjusting the distance between the reflector 10 and the resilient member 44 will be obvious to those of ordinary skill in the art. For example, instead of using threaded nuts on a support member with external threads, the adjustment mechanism could include sleeves that slide along the second support member 48 and engage the resilient member 44 to adjust the distance between the resilient member 44 and the reflector 10. The sleeves could frictionally engage the second support member 48 with sufficient force to hold the sleeves in place against the force of the resilient member 44 or, alternatively, use set screws to hold the sleeves in place. Additionally, the second support member 48 could be disposed adjacent the resilient member 44 instead of passing through an aperture in the resilient member 44, and include a nut, sleeve or other engagement member that engages the resilient member 44 such that a moment-free force may be applied to the resilient member 44. Other configurations for varying the distance between the distal end of the resilient member 44 and the reflector 10 will be obvious to those of ordinary skill in the art and are contemplated by the inventors as having use with the adjustment mechanism according to the present invention. Moreover, the adjustment mechanisms 40 could be disposed on the convex side of the reflector 10 with the first support member 42 mounted on another rigid structural member, such as the coupling fixture 12.

While the present invention has been described with reference to the specific examples, which are intended to be illustrative only and not to be limiting of the invention, it will be apparent to those of ordinary skill in the art that changes, additions, and/or deletions may be made to the disclosed embodiment without departing from the spirit and scope of the invention.

What is claimed is:

1. A shape adjustment mechanism for a concave antenna reflector fabricated from a resilient material and having a surface and a coupling member attached to the surface proximate the center of the reflector, comprising:

a first support member rigidly mounted on the coupling member;

a resilient member having a proximal end rigidly connected to the first support member and a distal end offset from the surface of the reflector by a distance;

a second support member having a first end rigidly connected to the reflector and a second end proximate the distal end of the resilient member; and an adjustment member coupled to the second support member and adapted to engage the distal end of the resilient member such that the distance between the distal end of the resilient member and the surface of the reflector is varied as the adjustment member moves longitudinally along the second support member.

2. A shape adjustment mechanism according to claim 1, wherein the resilient member is a leaf spring having an aperture proximate the distal end, wherein the second end of the second support member passes through the aperture.

3. A shape adjustment mechanism according to claim 2, wherein the adjustment member engage the resilient member proximate the aperture.

4. A shape adjustment mechanism according to claim 1, wherein the second support member has external threads and the adjustment member comprises a pair of nuts disposed on the second support member on opposite sides of the distal end of the resilient member, each nut having internal threads meshing with the external threads of the second support member.

5. A shape adjustment mechanism according to claim 4, wherein each of the nuts has a rounded surface which engages the resilient member.

6. A shape adjustment mechanism according to claim 4, wherein the resilient member has first and second spherical surfaces each adapted to engage one of the nuts.

7. A shape adjustment mechanism according to claim 1, wherein the surface of the reflector is disposed on the concave side of the reflector.

8. An antenna reflector, comprising:

a concave dish fabricated from a resilient material and having a surface;

a coupling member attached to the surface proximate the center of the dish;

a first support member rigidly mounted on the coupling member;

a resilient member having a proximal end rigidly connected to the first support member and a distal end offset from the surface of the dish by a distance;

a second support member having a first end rigidly connected to the dish and a second end proximate the distal end of the resilient member; and an adjustment member coupled to the second support member and adapted to engage the distal end of the resilient member such that the distance between the distal end of the resilient member and the surface of the dish is varied as the adjustment member moves longitudinally along the second support member.

9. An antenna reflector according to claim 8, wherein the resilient member is a leaf spring having an aperture proximate the distal end, wherein the second end of the second support member passes through the aperture.

10. An antenna reflector according to claim 9, wherein the adjustment member engage the resilient member proximate the aperture.

11. An antenna reflector according to claim 8, wherein the second support member has external threads and the adjustment member comprises a pair of nuts disposed on the second support member on opposite sides of the distal end of the resilient member, each nut having internal threads meshing with the external threads of the second support member.

12. An antenna reflector according to claim 11, wherein the each of the nuts has a rounded surface which engages the resilient member.

13. An antenna reflector according to claim 11, wherein the resilient member has first and second spherical surfaces each adapted to engage one of the nuts.

14. An antenna reflector according to claim 8, wherein the surface of the dish is disposed on the concave side of the dish.

15. A method for adjusting a concave antenna reflector fabricated from a resilient material and having a surface and a coupling member attached to the surface proximate the center of the reflector, comprising the steps of:

rigidly mounting a first support member on the coupling member and a second support member on the reflector;

rigidly connecting a resilient member to the first support member, the resilient member having a proximal end rigidly connected to the first support member and a distal end disposed proximate the second support member, wherein the distal end of the resilient member is separated from the surface of the reflector by a distance; and changing the distance between the distal end of the resilient member and the surface of the reflector by moving an adjustment member longitudinally along the second support member, wherein the adjustment member engages the distal end of the resilient member to move the distal end to one of increase and decrease the distance between the distal end and the surface.

16. A method for adjusting a concave antenna reflector according to claim 15, wherein the surface of the reflector is disposed on the concave side of the reflector.

* * * * *